US006946062B2

(12) United States Patent
Lin et al.

(10) Patent No.: US 6,946,062 B2
(45) **Date of Patent: *Sep. 20, 2005**

(54) ELECTROPOLISH/GRINDING MEANS FOR AN INNER SURFACE OF A LONG TUBE

(75) Inventors: Chun-Hung Lin, I-Lan (TW); Chen-Der Tsai, Hsinchu (TW); Hann-Tsong Wang, Hsinchu (TW); Jiun-Hung Chen, TaiChung (TW); De-Chang Lin, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 126 days.

This patent is subject to a terminal disclaimer.

(21) Appl. No.: 10/085,074

(22) Filed: Mar. 1, 2002

(65) Prior Publication Data

US 2003/0111338 A1 Jun. 19, 2003

(30) Foreign Application Priority Data

Dec. 13, 2001 (TW) ..... 90221767 U

(51) Int. Cl.[7] ..... C25F 3/16; B23H 5/06; B23H 5/10

(52) U.S. Cl. ..... 204/224 M; 335/220; 204/297.02; 204/225

(58) Field of Search ..... 310/90.5; 335/220; 204/243.1, 224 M, 272, 297.02; 205/662, 663, 686

(56) References Cited

U.S. PATENT DOCUMENTS

| | | | | | |
|---|---|---|---|---|---|
| 4,561,185 | A | * | 12/1985 | Sakata et al. | 33/817 |
| 4,585,282 | A | * | 4/1986 | Bosley | 310/90.5 |
| 4,601,802 | A | * | 7/1986 | Grimes et al. | 204/212 |
| 4,690,737 | A | * | 9/1987 | Vishnitsky | 205/670 |
| 4,733,054 | A | * | 3/1988 | Paul | 392/418 |
| 4,772,367 | A | * | 9/1988 | Menzel et al. | 205/653 |
| 5,099,216 | A | * | 3/1992 | Perline | 335/220 |
| 5,456,768 | A | * | 10/1995 | Tomari et al. | 148/280 |
| 5,958,195 | A | * | 9/1999 | Lorincz et al. | 204/224 M |
| 6,660,138 | B2 | * | 12/2003 | Lin et al. | 204/275.1 |
| 2003/0098245 | A1 | * | 5/2003 | Lin et al. | 205/640 |

FOREIGN PATENT DOCUMENTS

| | | | | |
|---|---|---|---|---|
| EP | 0951960 | A1 * | 10/1999 | B23H/5/00 |

* cited by examiner

*Primary Examiner*—Roy King
*Assistant Examiner*—Harry D. Wilkins, III
(74) *Attorney, Agent, or Firm*—Troxell Law Office, PLLC

(57) ABSTRACT

The present invention is an electropolishing/grinding device for an inner surface of a long tube, including at least one long tube, one electrode, at least two partitions, one fixed magnet mechanism, one driving apparatus and an axial driven mechanism. The fixed magnet mechanism and the driving apparatus form a magnetic levitation effect, which uses magnetic repulsiveness and magnetic attraction to keep the partitions away from the inner surface and avoid an eccentric situation. One of the two partitions has a plurality of springs, a plurality of protruding objects and a plurality of abrasive devices interconnected and firmly touching the inner surface of the tube for grinding.

7 Claims, 7 Drawing Sheets

ELECTROPOLISH/GRINDING MEANS FOR AN INNER SURFACE OF A LONG TUBE

FIELD OF THE INVENTION

The present invention is an electropolish/grinding device for an inner surface of a long tube, especially applied to a long tube of greater than 3 meters long and a diameter range under 5 cm.

BACKGROUND OF THE INVENTION

A process of electropolish is to connect a workpiece to an anode and a metal to a cathode, then the whole structure including the workpiece is put into a electrolyte and electrified with a direct current. The defects on workpiece surface are removed and the surface is then shinny and smooth. Features of electropolish are for improving surface cleanness, roughness, passivation, etc. For different fields of semiconductor, chemical industry, biochemical engineering, foodstuff industry, tubes are required to deliver fluids of those fields, and inner surfaces of those tubes are treated by polish or electrolysis for cleanness and anti-corrosion. Especially, products of IC/LCD/III-V require high standards of cleanness and anti-corrosion.

In prior arts of U.S. Pat. Nos. 4,826,582 and 4,849,084, which electropolish a 10-meter heat exchange tube, teach an electrode device for positioning a workpiece and sealing an electrolyte. The prior arts adopt a 3-layer structure for delivering the electrolyte with high pressure air, but said structure is complicated and only suitable for bigger diameter workpieces, not for diameters under 3 cm.

Prior art of U.S. Pat. No. 5,958,195 teaches the technology of electrolyzing and polishing an inner surface of a long and bended tube. However, to electrolyze and polish a bended tube, an electrode must move alone a bended curve without a short circuit. The most important parts are a flexible electrode and an insulation device. The insulation device is to avoid the short circuit and non-concentricity, but it blocks electrolyte flowing and makes a non-uniform electric field, etc.

Prior arts of U.S. Pat. Nos. 4,601,802 and 4,705,611 offer a fixture applied inside a tube, and the fixture stabilizes a plurality of axially rotating tubes simultaneously. An end connector can circulate tube and exhaust gas from an upper end, and the electrolyte can be recycled after overflowing. An electrode length is equal to the tube's length, therefore a huge space and a super power supplier are needed to fit such conditions.

Based on the aforesaid issues, the inventor of the present invention has being studied and referred to practical experiences and theory for designing and effectively improving the prior arts.

SUMMARY OF THE INVENTION

The first object of the present invention is to provide an electropolishing/grinding device for an inner surface of a long tube that improves an electrode design and applies a theory of large and fine polishing to improve a manufacturing rate of a tube with an electropolished surface and an improved passivation effect.

The second object is to provide an electropolishing/grinding device for an inner surface of a long tube that can electrolyze and polish an inner surface of a tube longer than 3 meters and with a diameter under 5 cm. The structure of the device is simple to reduce equipment cost.

The third object is to provide an electropolishing/grinding device for an inner surface of a long tube that avoids short circuiting and non-concentricity problems. An electrode of the present invention is installed through a center of a partition. The electrode is positioned a certain distance from the inner surface of the tube because the partition supports electrode. Therefore, the short circuit and non-concentricity are solved; further, the electric field is kept uniform because of the partition is round.

The fourth object is to provide an electropolishing/grinding device for an inner surface of a long tube that includes a multi-sectioned electrode. The electrode can be added in different sections depending on needs to improve electropolish result, and to reduce storage space.

The appended drawings will provide further illustration of the present invention, together with description; serve to explain the principles of the invention.

DETAILED DESCRIPTION OF THE PRESENT INVENTION

Different fields of semiconductor, chemical industry, biochemical engineering, foodstuff industry require inner surfaces of tubes be treated by electrolyzing and polishing to improve surface cleanness, roughness and passivation results. The present invention comprises an electrolyte delivering system, which makes electrolyte uniformly through an inner surface of a long tube. A cable guides a direct current to a working area of an inner surface of tube. The electrolyte is an electrifying media to make a complete electric path, wherein a magnetic-levitated device can be added on, which drives an electrode axial motion and revolving motion, and to avoid contact between a negative electrode and the positive inner surface. Some abrasive blocks are installed in a radial top of the partition such as $Al_2O_3$, etc. The abrasive blocks cooperate with a plurality of closed fillisters, springs and thimbles for constantly keeping the abrasive blocks on the inner surface, which results in grinding and electropolishing.

Figure 1:
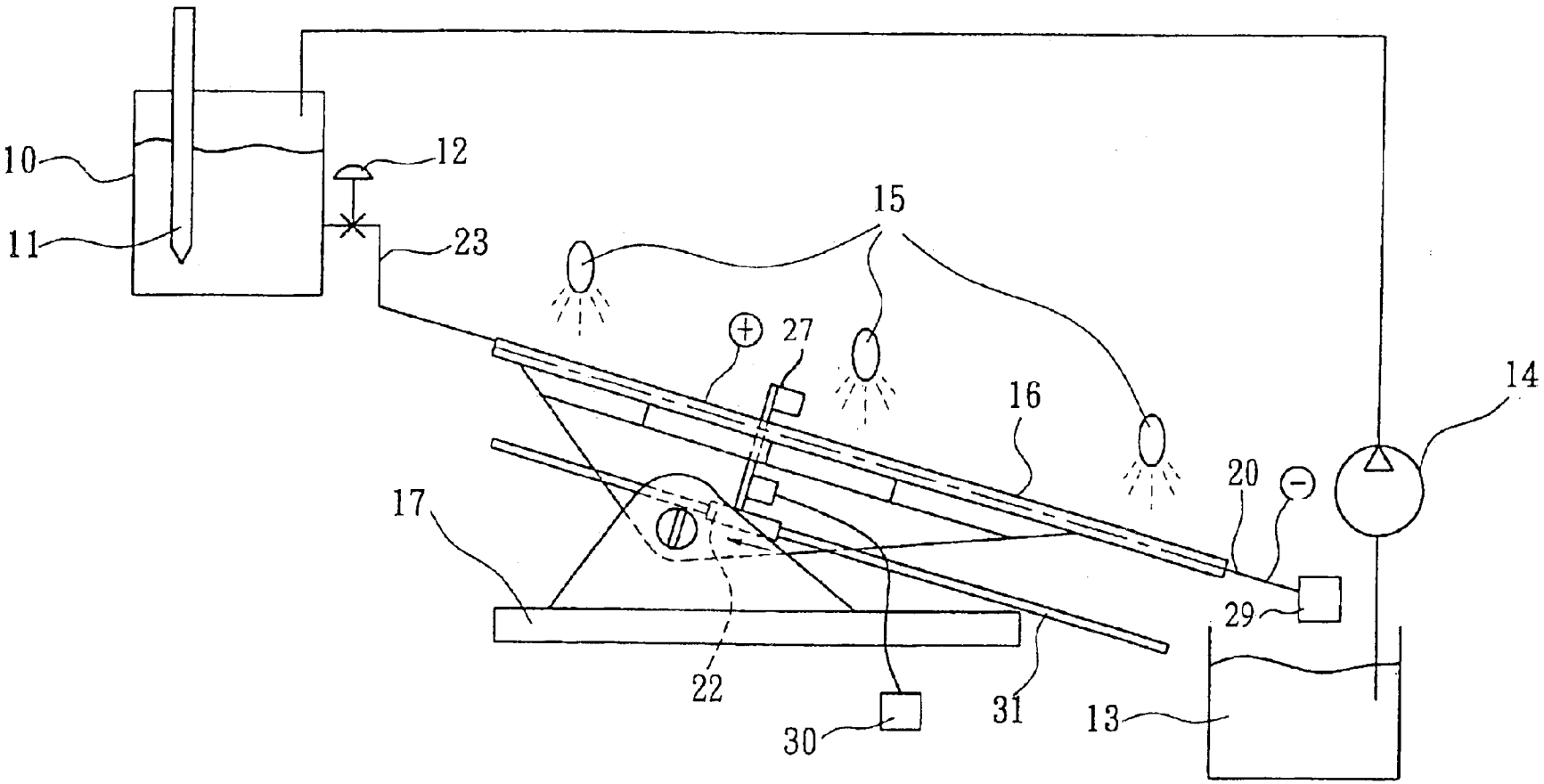
FIG. 1 is a scheme of a practical application of the present invention.

Referring to FIG. 1, which is a scheme of a practical application of the present invention, electrolyte is stored in a tank 10. There is a heater 11 in the tank 10 to keep warming and heating the electrolyte. Electrolyte passes through a switch 12 and a pipe 23 to a tube 16, wherein the switch 12 is made of Teflon or other heat-resistant and acid-proof materials. The tube 16 is placed on an inclined platform 17, and thus a higher end of tube 16 connects to the pipe 23 for electrolyte passing from higher end to a lower end. Inclined angles of the inclined platform 17 can be adjusted to control electrolyte flowing speeds. Tube 16 has an electropolishing device inside, which connects to a first power device 29 via a cable 20. The first power device 29 supplies a direct current for the electropolishing reaction. The present invention adopts that electron exchanging from an anode half reaction and a cathode half reaction to generate an electropolishing result. Tube 16 is an anode, thus an inner surface of tube 16 is anode, and an anode looses electrons. The electrode is a cathode, and a cathode receives electrons. FIG. 1 does not show the electrode, so only cable 20 is shown to represent the connection. Tube 16 is 2 meters long or more, so electrolyte temperature is lower on a lower end of tube 16, thus a plurality of halogen bulbs 15 are placed around tube 16 for heating. Electrolyte is recycled in a recycling tank 13 after passing through tube 16, then it is delivered back to tank 10 by a pump 14 that is heat-resistant and acid-proof. A driving apparatus 27 is located around the tube 16 and has several outer electromagnets 271, when the outer electromagnets 271 are powered by a second power device 30, they generate a electromagnetic force that associates with a plurality of fixed magnets 281, revolving the fixed magnets, thus the electropolishing device in tube 16 rotates. A n axial driven mechanism 22 carries the driving apparatus 27 and is mounted on a guiding rod mechanism 31. The axial driven mechanism 22 moves the guiding rod mechanism 31 to move the driving apparatus 27 parallel to the tube 16. In one embodiment, axial driven mechanism 22 moves from lower to higher position when electropolishing thereby exhausting air bubbles generated by the reaction. The complete process will be described in detail below.

Figure 2:
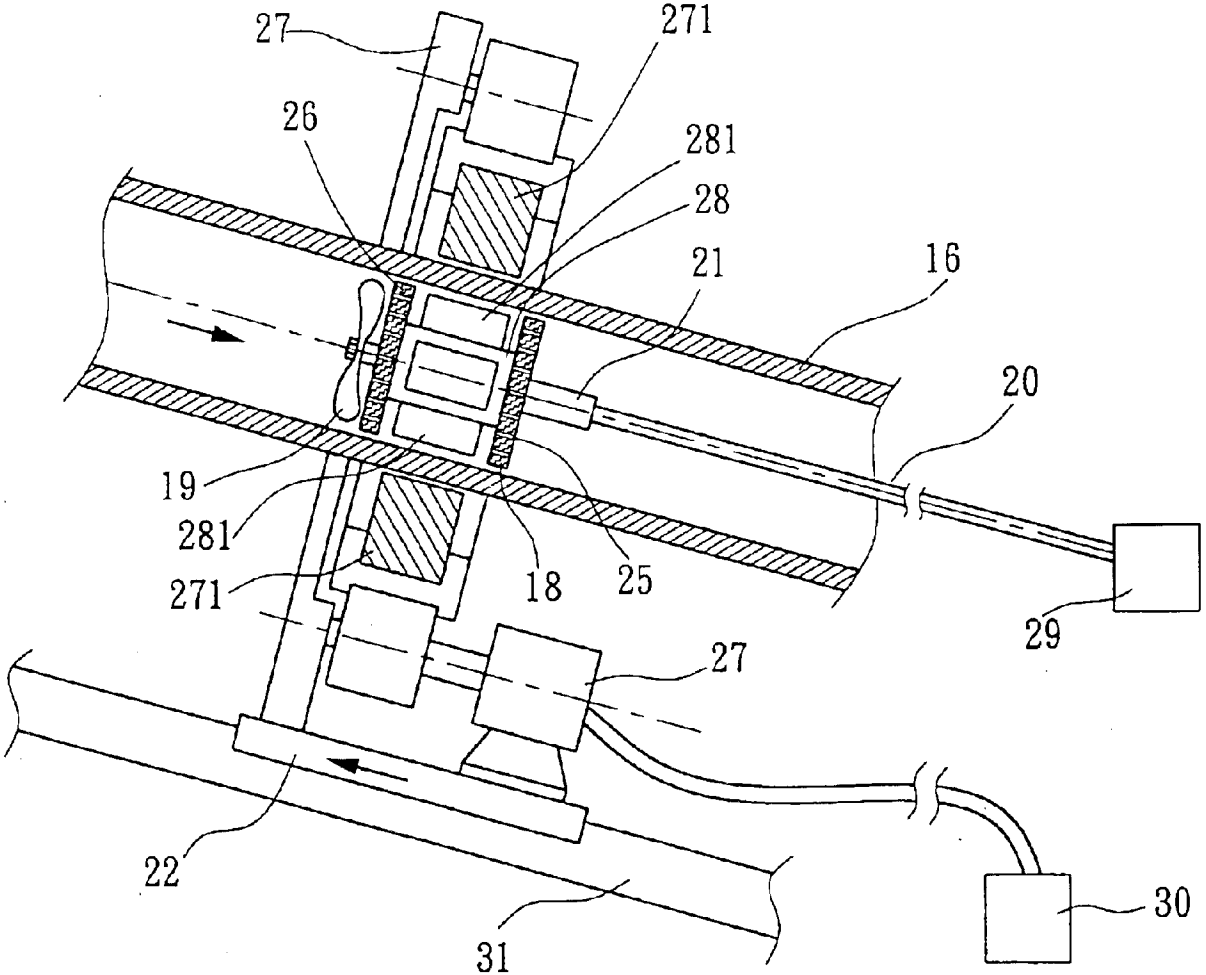
FIG. 2 is a first preferred embodiment of the present invention.
Figure 7:
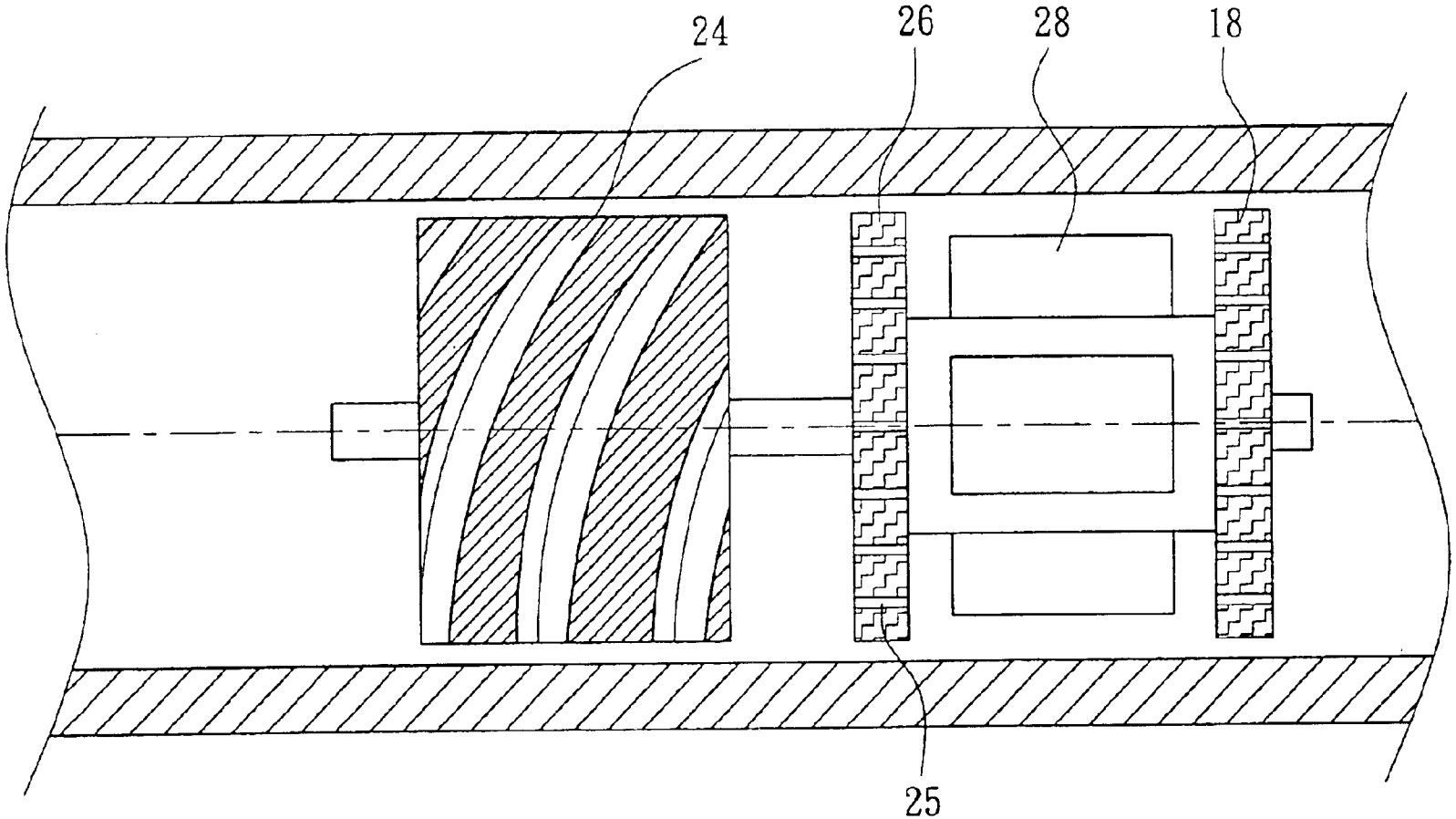
FIG. 7 is a preferred embodiment of the long tube of the present invention.

Referring to FIG. 2, which is a first preferred embodiment of the present invention. This embodiment relates to polishing an inner surface of the tube 16, which is longer than 3 meters and made of SUS300 series without polarization. The embodiment comprises a fixed magnet mechanism 28 including the plurality of fixed magnets 281, which are positioned with the longest sides located axially and combined and formed as the fixed magnet mechanism 28. At least one electrode 21, which is made of copper and tungsten, and end of the electrode 21 is bounded a cable 20, which connects to a first power 29 outside of t he tube 16 for power supply. At least two partitions, which are made of Teflon or materials without electric conductivity for limiting electropolishing range , and to save power and enhance electropolishing result. Please refer to FIG. 3, which is a preferred embodiment of a partition of the present invention, including a plurality of slots 25 designed on an outer edge of the partition. The slots make electrolyte flow close to an inner surface more fluently. A boundary layer is broken to generate an average anode membrane, thus air bubbles generated by electropolishing are exhausted fast. Further, the partitions 18 and 26 have many holes as meshes for fluently introducing electrolyte, to avoid contact of negative electrode 21 and positive inner surface and figure out non-average polishing of eccentric electrode, dimensions of the partitions cannot be enlarged. The present invention takes the driving apparatus 27 and the fixed magnet mechanism 28 to form a magnetic levitation effect, which means using magnetic repulsiveness and magnetic attraction to keep the partitions away from the inner surface and avoid the eccentric situation. The first partition 18 is on a first end of the electrode 21 opposite a second end connected to the cable 20. The fixed magnet mechanism 28 is between the first partition 18 and the second partition 26. Further, the fixed magnet mechanism 28 is radially and uniformly distributed on the two partitions, a surface of the second partition 26 of the fixed magnet mechanism 28 has a propeller mechanism 19, and the propeller mechanism can be a propeller or as shown in FIG. 7, which is a preferred embodiment of the long tube of the present invention, a screw slideway 24, and it is to quickly remove air bubbles generated from the electropolishing reaction. The driving apparatus 27, comprises a plurality of outer electromagnets 271 distributed around the tube 16, and positioned in the tube 16 relative to the fixed magnet mechanism 28, which connects to the second power device 30 for supplying power to outer electromagnets 271 and the axial driven mechanism 22. The axial driven mechanism 22 carries both the driving apparatus 27 and the second power device 30 for axially moving aforesaid apparatus and device, the moving speed is from 5 to 20 cm/min. Electrode 21, two partitions 18 and 26 and fixed magnet mechanism 28 are in tube 16, and cooperate with driving apparatus 27. The electromagnet force drives the fixed magnets 281 in fixed magnet mechanism 28, therefore electrode 21, two partitions 18 and 26 and fixed magnet mechanism 28 are rotated along the same axis. Axial driven mechanism 22 simultaneously drives driving apparatus 27 and second power device 30. The present invention also moves parallel to the axis. Finally when electrode 21 connects to first power device 29, a complete electropolishing reaction in a long tube is performed.

As mentioned above, driving apparatus 27 is an electromagnet apparatus. When driving apparatus 27 connects to second power device 30, a plurality outer electromagnets 271 are then driven, and a plurality of fixed magnets 281 in fixed magnet mechanism 28 rotate as well. The rotation speed is 10 to 200 rpm. On the other hand, driving apparatus 27 is a rotational mechanism. When driving apparatus 27 connects to second power device 30, a plurality of outer electromagnets 271 in driving apparatus 27 are driven via direct mechanical transmission, and a plurality of fixed magnets 281 in fixed magnet mechanism 28 are in rotation as well.

Figure 4:
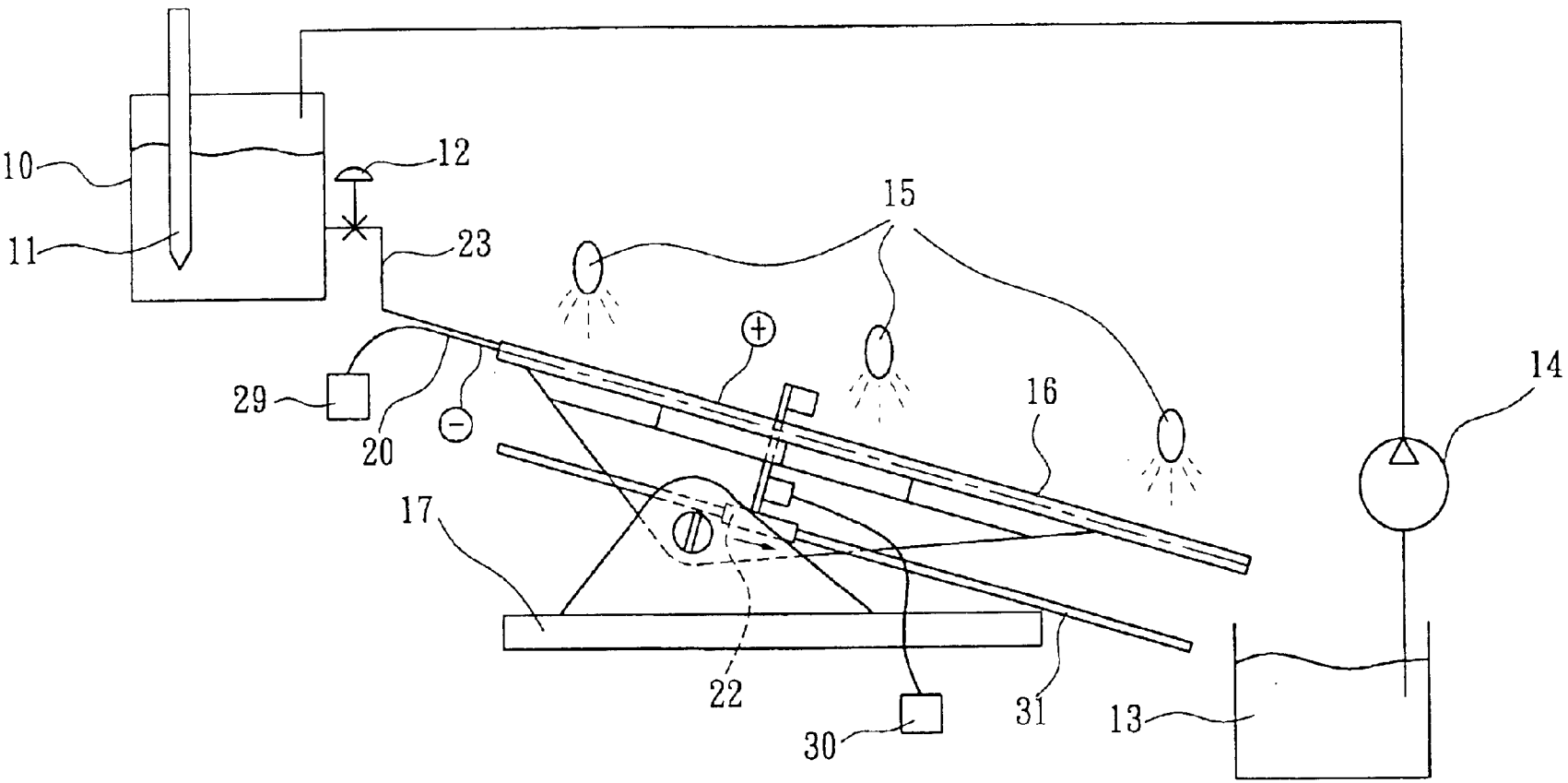
FIG. 4 is a scheme of a practical application of the present invention.

Please refer to FIG. 4, which is a scheme of a practical application of the present invention and a preferred embodiment of electropolishing of the present invention. The embodiment locates the electrode on a front place, and a front end of electrode is bounded by cable 20, which connects to first power device 29. When the electropolishing action is performed on, axial driven mechanism 22 also moves from a higher to a lower position for exhausting particles generated by polishing.

Figure 3:
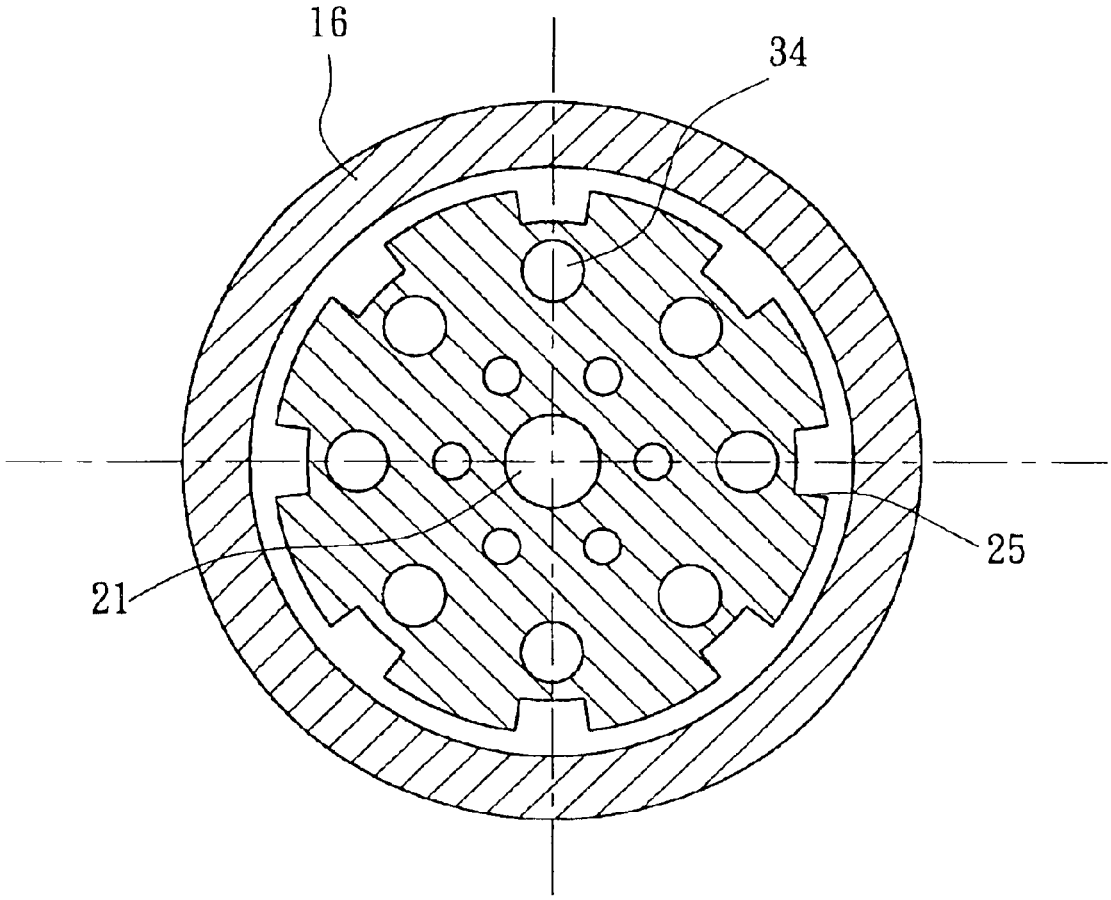
FIG. 3 is a preferred embodiment of a partition of the present invention.
Figure 5:
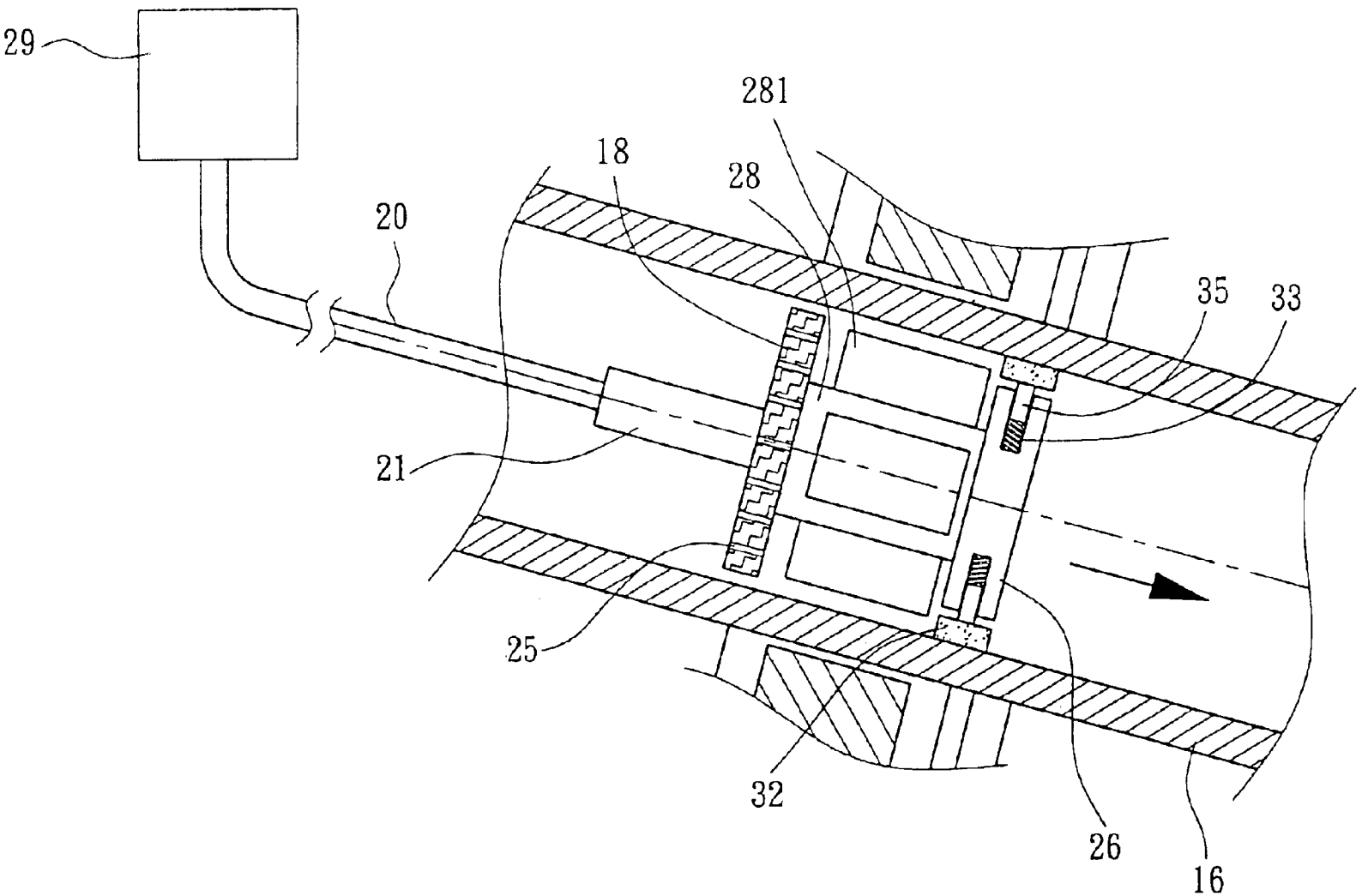
FIG. 5 is a partial enlarged view of a preferred embodiment of along tube of the present invention.
Figure 6:
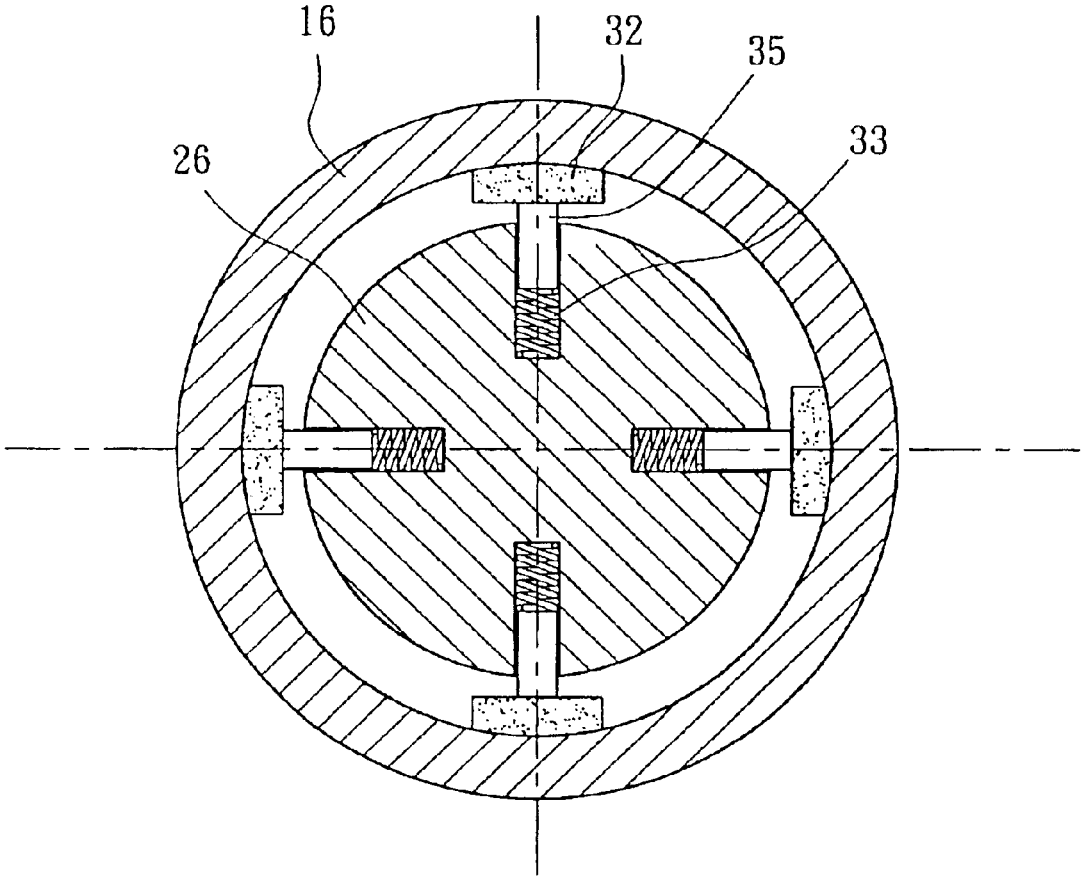
FIG. 6 is a sectional view of a preferred embodiment of the partition of the present invention.

Referring to FIG. 5, which is a partial enlarged view of a preferred embodiment of a long tube of the present invention, which is located in the inner surface of tube 16 full of electrolyte, and tube 16 is made of SUS300 series without polarization and longer than 3 meters. The present invention includes the fixed magnet mechanism 28, including plural fixed magnets 281, which are axially positioned along the longest sides thereof and combined and formed to become the fixed magnet mechanism 28; at least one electrode 21, which is made of copper and tungsten, an end of the electrode 21 is bounded a cable 20, which connects to the first power device 29 outside of the tube 16 for power supply; at least two partitions, which are made of Teflon or materials without electric conductivity for limiting electropolishing range. The present invention saves power and enhances the electropolishing result. Please refer to FIG. 3, which is a preferred embodiment of the partition of the present invention, plural slots 25 are designed on an outer edge of the first partition 18. The slots 25 make electrolyte flow close to the inner surface more fluently, a boundary layer is then broken to generate an average anode membrane, thus air bubbles generated by electropolishing are exhausted fast. Further as shown in FIG. 3, the partitions 18 and 26 have many holes 34 as meshes for fluently introducing electrolyte, to avoid contact of negative electrode 21 and positive inner surface and figure out non-average polishing of eccentric electrode, dimensions of the partition 18 cannot be enlarged. The present invention takes the driving apparatus 27 (not shown in FIG. 5) and the fixed magnet mechanism 28 to form a magnetic levitation effect, which means using magnetic repulsiveness and magnetic attraction to keep the partitions away from the inner surface and avoid the eccentric situation. The first partition 18 is on a first end of the electrode 21 opposite a second end connected to the cable 20. The fixed magnet mechanism 28 is between the first partition 18 and the second partition 26. Further, the fixed magnet mechanism 28 is radially and uniformly distributed on the two partitions. Referring to FIG. 6, which is a sectional view of preferred embodiment of the partition of the present invention, there are a plurality of closed fillisters placed on a radial end of the second partition 26, and each of the closed fillisters has a spring 33 and a thimble 35. The thimble 35 protrudes outside the radial end and supports an abrasive device 32 made of $Al_2O_3$, and the abrasive device 32 continuously presses against the inner surface of tube for grinding. Following components of the present embodiment can be same as FIG. 2, which comprises the driving apparatus 27, the plurality of outer electromagnets 271 distributed around the tube 16, and positioned in the tube 16 relative to the fixed magnet mechanism 28, which connects to the second power device 30 for supplying power to outer electromagnets 271; and the axial driven mechanism 22, which carries both the driving apparatus 27 and the second power device 30 for axially moving aforesaid apparatus and device. The moving speed is from 5 to 20 cm/min. Electrode 21, two partitions 18 and 26 and fixed magnet mechanism 28 are in tube 16, and cooperate with driving apparatus 27. The electromagnet force drives the fixed magnets 281 in fixed magnet mechanism 28, therefore electrode 21, two partitions 18 and 26 and fixed magnet mechanism 28 are rotated along the same axis. The axial driven mechanism 22 simultaneously drives driving apparatus 27 and second power device 30. The present invention moves parallel to the axis of tube 16. When electrode 21 is connected to first power device 29, a complete electropolishing reaction in a long tube is performed.

As mentioned above, the driving apparatus 27 is an electromagnet apparatus, when the driving apparatus 27 connects to second power device 30, the plurality of outer electromagnets 271 are then driven, and the plurality of fixed magnets 281 in fixed magnet mechanism 28 are rotated as well. The rotation speed is 10 to 200 rpm. On the other hand, driving apparatus 27 is rotational mechanism, when driving apparatus 27 connects to second power device 30, the plurality of outer electromagnets 271 in driving apparatus 27 are driven via direct mechanical transmission, and the plurality of fixed magnets 281 in fixed magnet mechanism 28 are in rotation as well.

While the present invention has been shown and described with reference to preferred embodiments thereof, and in terms of the illustrative drawings, it should be not considered as limited thereby. Thus, the present invention is infinitely used. However, various possible modification, omission, and alternations could be conceived of by one skilled in the art to the form and the content of any particular embodiment, without departing from the scope and the spirit of the present invention.

The invention is disclosed and is intended to be limited only the scope of the appended claims and its equivalent area.

What is claimed is:

1. An electropolishing device for electropolishing an inner surface of a long tube comprising:

a) a fixed magnet mechanism having a plurality of fixed magnets, each of the plurality of fixed magnets positioned with a long side parallel with an axis of the long tube;

b) first and second partitions located such that the fixed magnet mechanism is located between and axially aligned with the first and the second partitions;

c) a cable connected to a first power supply;

d) at least one electrode connected at a first end to the cable and at a second end to the first partition, the at least one electrode located in an interior of the long tube, the cable providing a direct current to the at least one electrode;

e) a driving apparatus connected to a second power supply and having a plurality of outer electromagnets positioned around an outer periphery of the tube, the plurality of outer magnets generating an electromagnetic force that positions the fixed magnet mechanism within the tube and rotates the fixed magnet mechanism and the first and the second partitions on the axis of the tube;

f) an axial driven mechanism moves the driving apparatus along the axis of the tube, the axial movement of the driving apparatus and the rotation of the fixed magnet mechanism and the first and the second partitions are performed simultaneously, such that a flow of an electrolyte and the movement of the electrode through the tube electropolishes the inner surface of the long tube; and g) a screw structure connected to the second partition opposite the fixed magnet mechanism.

2. The electropolishing device according to claim 1, wherein the first and second partitions are made of a material without electric conductivity.

3. The electropolishing device according to claim 1, wherein each of the partitions has a plurality of slots formed on an outer periphery such that the electrolyte flows between the plurality of slots and the inner surface of the long tube.

4. The electropolishing device according to claim 1, wherein each of the partitions has a plurality of holes through which the electrolyte flows.

5. The electropolishing device according to claim 1, wherein the screw structure is selected from the group consisting of a propeller and a screw slideway.

6. The electropolishing device according to claim 1, wherein the driving apparatus is an electromagnet apparatus, the plurality of outer electromagnets are driven and the plurality of fixed magnets are rotated when the driving apparatus is connected to the second power supply.

7. The electropolishing device according to claim 1, wherein the driving apparatus is an rotational apparatus, the plurality of outer electromagnets are driven by a direct mechanical transmission and the plurality of fixed magnets are rotated when the driving apparatus is connected to the second power supply.

* * * * *